US007394905B2

(12) United States Patent
Miller et al.

(10) Patent No.: US 7,394,905 B2
(45) Date of Patent: Jul. 1, 2008

(54) VOICE AMPLIFIER FOR MASK

(75) Inventors: Mark Miller, Parma, OH (US); Frank Torrieri, Perry, OH (US)

(73) Assignee: Ultra Electronics Audiopack, Inc., Garfield Hts., OH (US)

( * ) Notice: Subject to any disclaimer, the term of this patent is extended or adjusted under 35 U.S.C. 154(b) by 840 days.

(21) Appl. No.: 10/810,946

(22) Filed: Mar. 26, 2004

(65) Prior Publication Data

US 2005/0213782 A1 Sep. 29, 2005

(51) Int. Cl.
*H04R 27/04* (2006.01)

(52) U.S. Cl. ..... 381/75; 381/376; 381/367; 128/201.19

(58) Field of Classification Search ..... 381/110, 381/72, 75, 375–6, 367; 128/201.19
See application file for complete search history.

(56) References Cited

U.S. PATENT DOCUMENTS 4,400,591 A * 8/1983 Jennings et al. ..... 381/61
4,508,936 A * 4/1985 Ingalls ..... 381/79
4,900,591 A * 2/1990 Bennett et al. ..... 427/255.17
4,901,356 A 2/1990 Bauer
5,136,657 A * 8/1992 Hattori ..... 381/181
5,138,666 A 8/1992 Bauer et al.
5,224,474 A * 7/1993 Bloomfield ..... 128/201.19
5,371,804 A 12/1994 Bauer
5,428,688 A 6/1995 Becker et al.
5,463,693 A 10/1995 Birli et al.
5,503,141 A * 4/1996 Kettl et al. ..... 128/201.19
5,566,362 A 10/1996 Bauer
5,860,417 A * 1/1999 Kettl et al. ..... 128/201.19
6,644,308 B2 * 11/2003 Kalhok et al. ..... 128/201.24
7,006,648 B2 * 2/2006 Wang ..... 381/336
7,089,930 B2 8/2006 Adams
7,110,743 B2 9/2006 Depew et al.
7,221,966 B2 5/2007 Birli et al.
2003/0224838 A1 12/2003 Skillicorn et al.
2005/0008183 A1 * 1/2005 Skillicorn ..... 381/367
2005/0058317 A1 * 3/2005 Montgomery ..... 381/376
2005/0063561 A1 3/2005 Birli et al.
2005/0201548 A1 9/2005 Birli et al.
2005/0213782 A1 9/2005 Miller et al.
2006/0050917 A1 3/2006 Skillicorn et al.
2006/0177084 A1 8/2006 Skillicorn et al.
2007/0049360 A1 3/2007 Birli et al.

* cited by examiner

*Primary Examiner*—Vivian Chin
*Assistant Examiner*—Paul Disler
(74) *Attorney, Agent, or Firm*—Fay Sharpe LLP; Brian E. Trung

(57) ABSTRACT

A voice amplifier for attachment to a mask has a sound reflector that faces outwardly of the mask when the voice amplifier is attached to the mask. A speaker faces inwards towards the sound reflector. Sound waves emanate from the speaker inward towards the sound reflector, reflect off the sound reflector and exit the voice amplifier through an outer peripheral gap and travel outwardly from the mask. The voice amplifier has an on/off switch mounted on the front of the voice amplifier. The voice amplifier cover has a front wall with a front surface facing away from the mask. The narrow end of the speaker is located closer to the front wall of the cover than the wide end. The cover front wall follows the profile of the speaker in a direction from the narrow end to the wide end of the speaker.

47 Claims, 5 Drawing Sheets

VOICE AMPLIFIER FOR MASK

BACKGROUND OF THE INVENTION

The present invention relates generally to voice transmission systems for protective masks and more particularly to a voice amplifier for installation on a protective mask.

Protective face masks or respirators for the human face are well known. Persons wearing such devices often have a need to communicate with one another, particularly in emergency situations. Masks not equipped with voice amplification mechanisms are typically provided with a valve through which the wearer both exhales and speaks. Sound transmitted through such valves, however, is somewhat muffled, and thus various communications systems have been developed to improve sound transmission capabilities.

Such systems typically include an on-off switch, a microphone, an amplifier, and a speaker. It is desirable to have such systems be as small as possible while still providing good sound quality and volume. It is also desirable to have the on-off switch be easily accessible by a user who may be wearing, for example, a heavy glove.

SUMMARY OF THE INVENTION

The invention relates to a voice amplifier for attachment to a mask. In one aspect, the invention includes a voice amplifier having a sound reflector with a reflector surface that faces outwardly of the mask when the voice amplifier is attached to the mask. A base is connected with the sound reflector. A speaker is supported on the base and faces inwards towards the reflector surface. Sound waves emanate from the speaker inward towards the sound reflector, reflect off the sound reflector and exit the voice amplifier through an outer peripheral gap and travel outwardly from the mask.

In another aspect of the invention, the voice amplifier includes a switch, which may be magnetically actuated, and a movable actuator mounted on the front of the voice amplifier.

In another aspect of the invention, the voice amplifier cover has a front wall with a front surface facing away from the mask when the voice amplifier is attached to the mask. The speaker has a wide end and a narrow end. The narrow end of the speaker is located closer to the front wall of the cover than the wide end. The cover front wall has a profile that follows the profile of the speaker in a direction from the narrow end of the speaker to the wide end of the speaker.

In another aspect of the invention, the cover has an upper portion with an outer surface portion facing away from the mask, the voice amplifier further comprising a circuit board located within the housing at a location not between the speaker and the outer surface portion of the upper portion of the cover. The inwardly facing speaker allows the circuit board to be mounted directly behind the cover of the voice amplifier. This configuration allows the housing of the voice amplifier to be contoured to occupy less space and allows the on/off switch to be mounted to the front of the cover of the voice amplifier and connect directly with the circuit board.

DETAILED DESCRIPTION OF THE INVENTION

Figure 2:
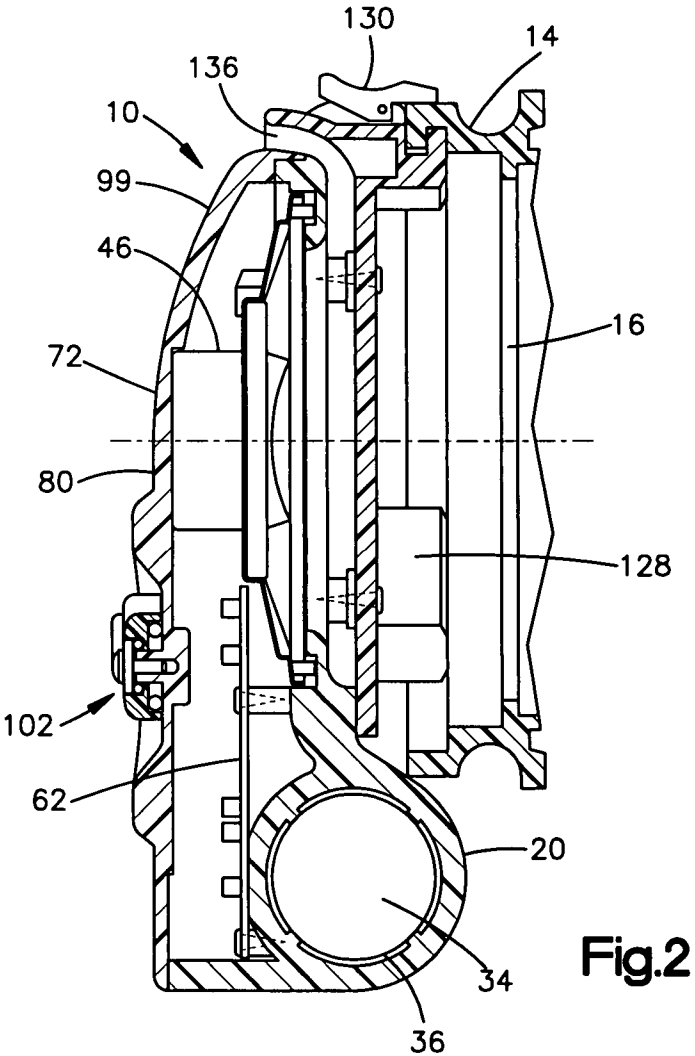
FIG. 2 is a sectional view of the voice amplifier of FIG. 1.
Figure 1:
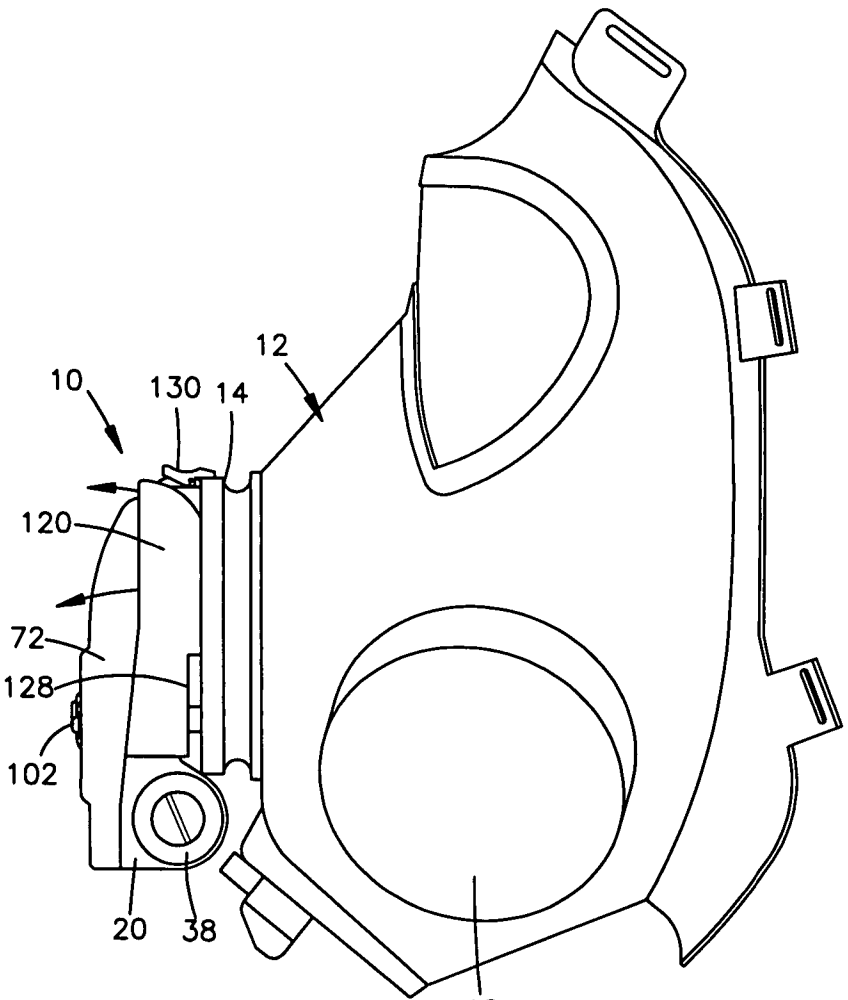
FIG. 1 is a side elevational view of a mask with a voice amplifier in accordance with the present invention.

The present invention relates generally to voice transmission systems for protective masks and more particularly to a voice amplifier for installation on a protective mask. The invention is applicable to voice amplifiers of differing constructions. As representative of the invention, FIGS. 1 and 2 illustrate a voice amplifier 10 that is one embodiment of the invention. The voice amplifier 10 is mounted on a mask shown schematically at 12. The mask 12 has a mounting portion 14 that supports the voice amplifier 10. The mounting portion 14 has an opening 16 (FIG. 2) through which sound is communicated to the voice amplifier 10 from the user and/or exhale air is passed through the mask. In one alternate embodiment, a microphone is located inside the mask 12 and is connected to the voice amplifier 10 via a cable or other connector not shown. In another embodiment, a wireless microphone/transmitter is used that communicates, via radio signals, to a receiver/amplifier outside of the mask 12.

Figure 6:
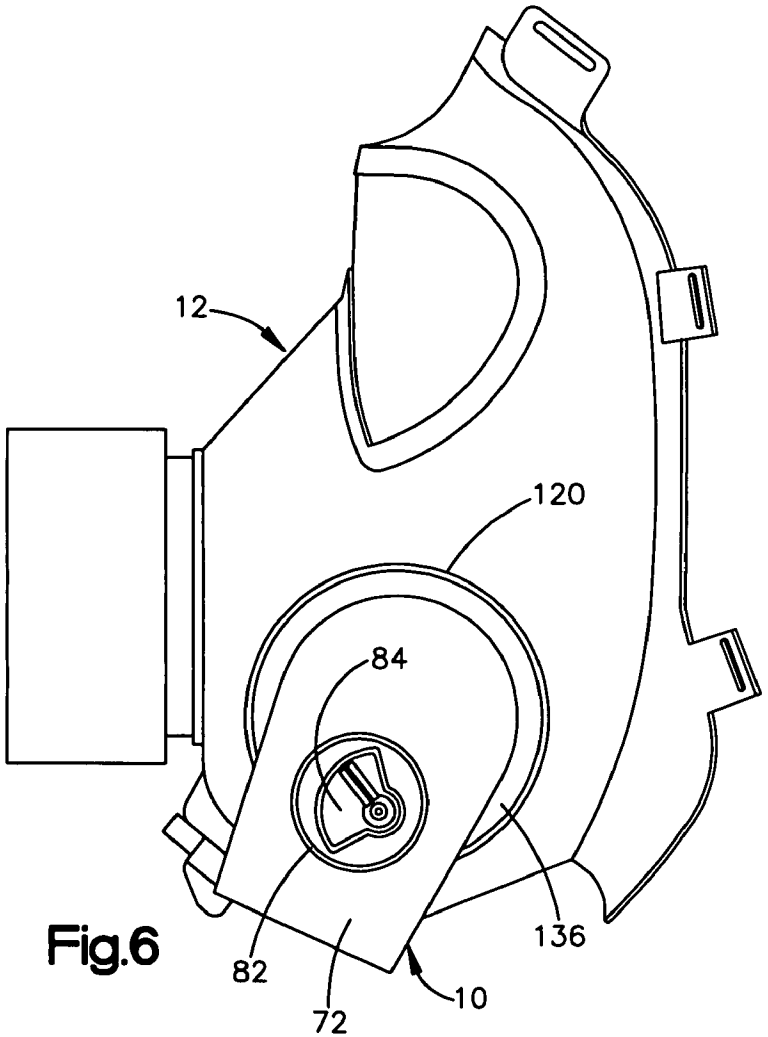
FIG. 6 is view similar to FIG. 1 showing a voice amplifier of the present invention in an alternative location on a mask.

As shown in FIG. 1 the mounting portion 14 of the mask 12 is located on the front of the mask, and a respirator portion 18 of the mask is located off to one side. As shown in FIG. 6, a voice amplifier 10 of the present invention can be mounted at an alternative location on a mask, for example, a side of the mask, with the respirator located on the front of the mask. Alternatively, the voice amplifier 10 may be mounted in or to a breathing opening of a mask without interfering with the operation of the breathing opening. The voice amplifier 10 can also be attached to a solid portion of a mask, that is, one without an opening, if a suitable inside microphone is provided. The voice amplifier 10 may alternatively be attached or mounted to a helmet of other type of headgear.

Figure 3:
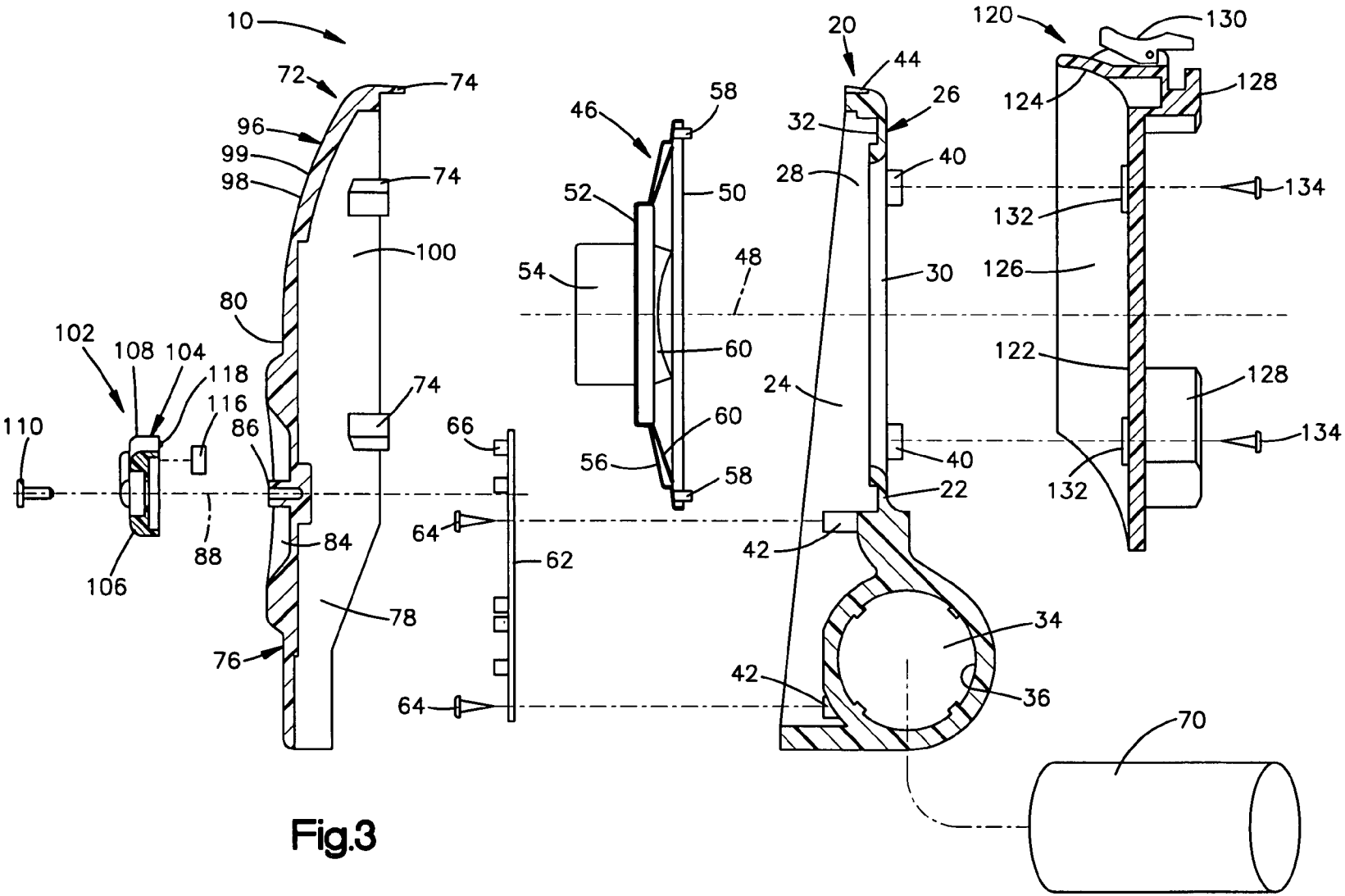
FIG. 3 is an exploded view showing in section the parts of the voice amplifier of FIG. 1.
Figure 4:
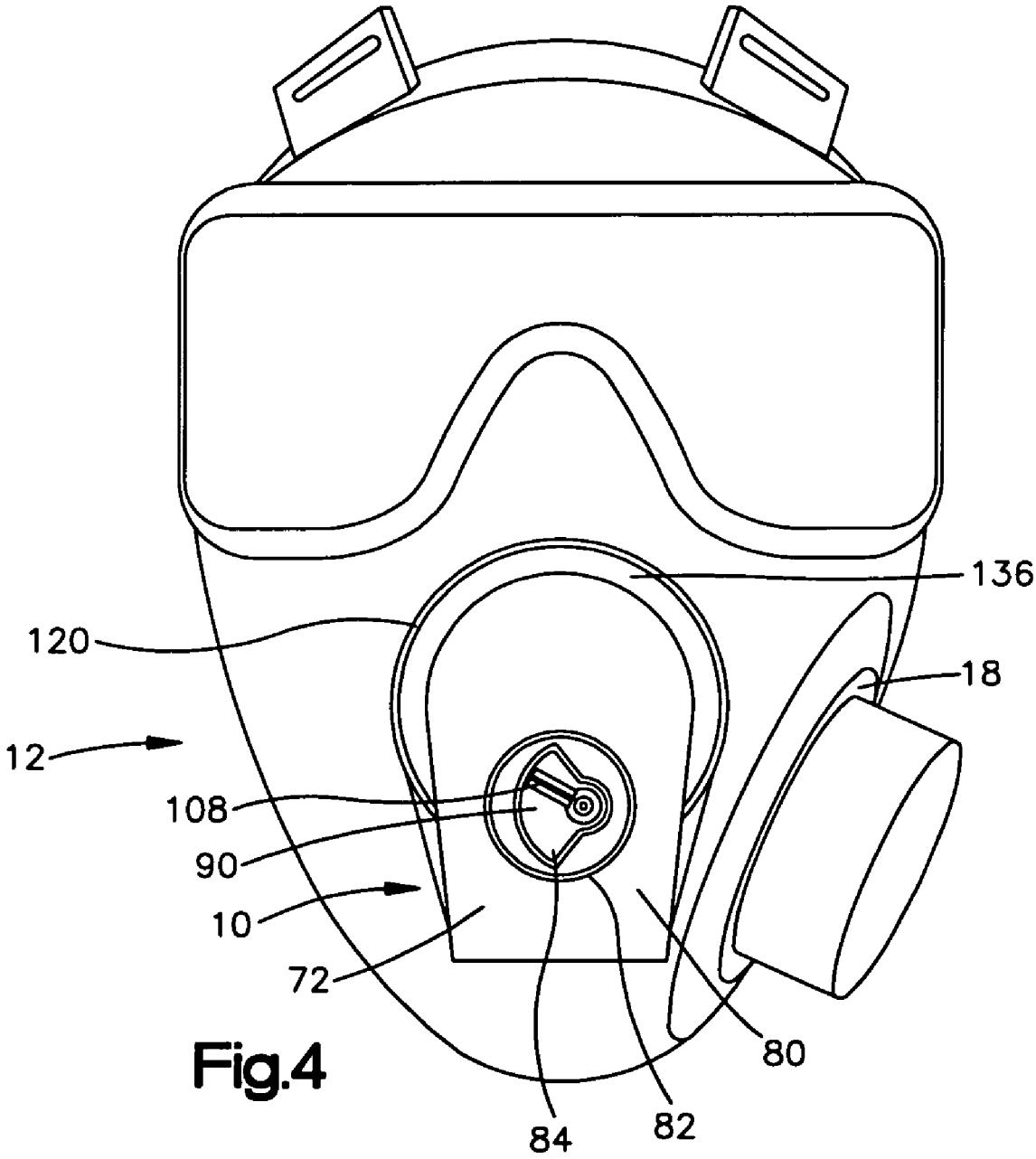
FIG. 4 is a front elevational view of the mask and voice amplifier of FIG. 1.
Figure 5:
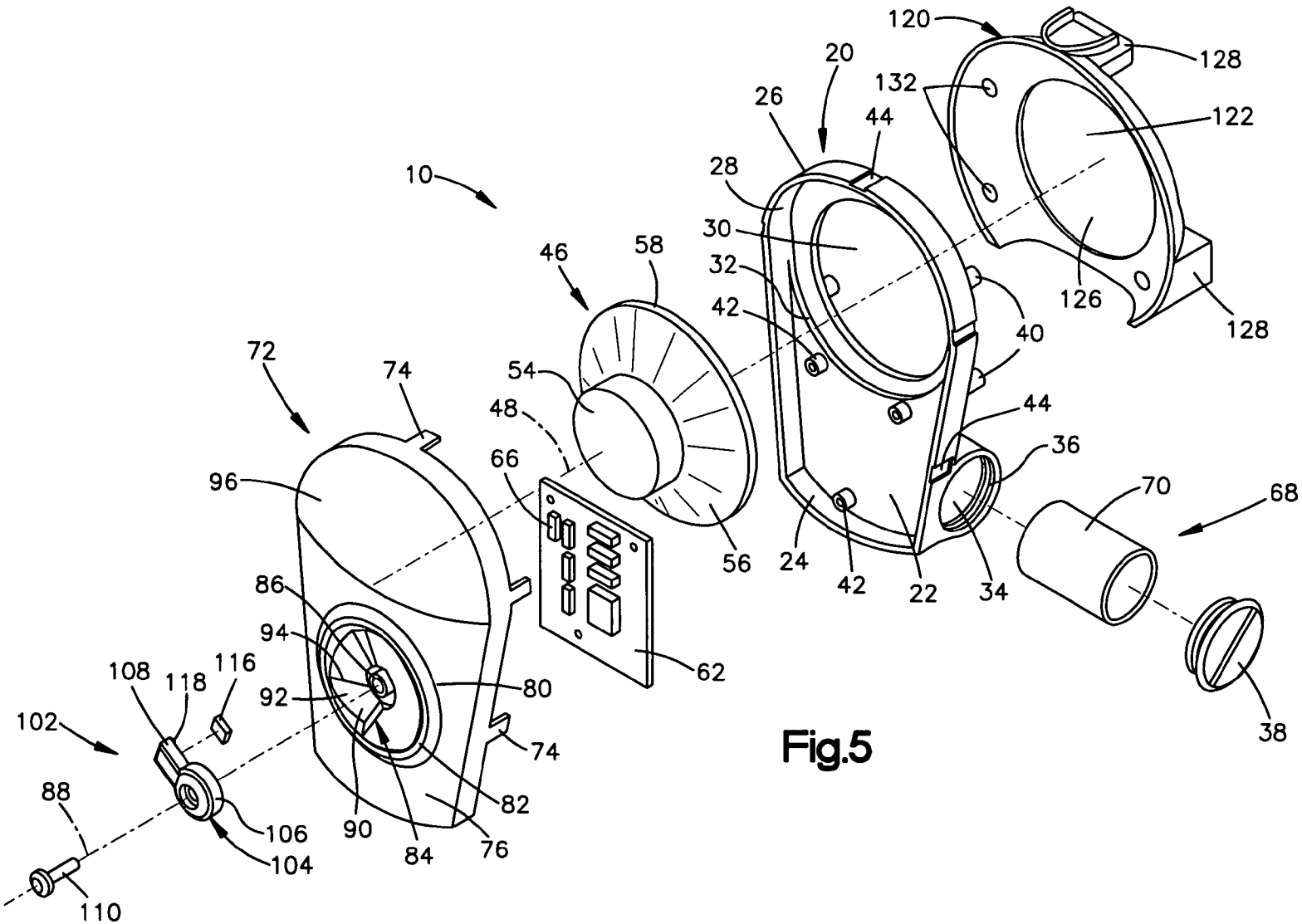
FIG. 5 is an exploded perspective view showing the parts of the voice amplifier of FIG. 1.
Figure 7:
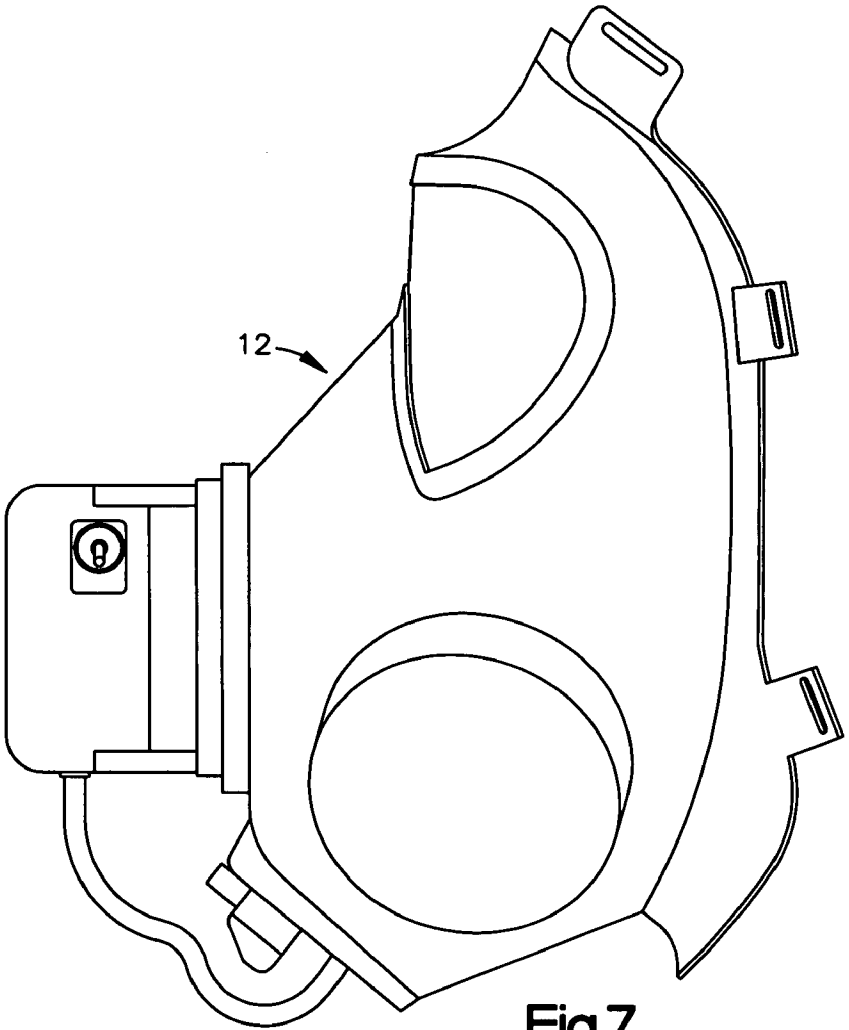
Fig.7 PRIOR ART
FIG. 7 is a view similar to FIG. 1 of a mask with a prior art voice amplifier.

The voice amplifier 10 (FIGS. 2, 3 and 5) includes a main housing, or base, 20. The base 20 is preferably molded as one piece from a suitable material, such as plastic. The configuration of the base 20 is adapted to support and enclose other components of the assembly. The base 20 includes a base wall 22. The base wall 22 has a peripheral wall 24 adapted to enclose other components of the assembly.

A semi-circular rim 26 projects upward from the base wall 22. The semi-circular rim 26 has a peripheral wall 28 that projects outward (to the left as viewed in FIG. 3) from the rim. The semi-circular rim 26 defines a base opening 30 adapted to allow sound waves to travel through the base 20 of the voice amplifier 10. In the illustrated embodiment, the opening 30 is circular. Alternatively, the opening 30 could have a different shape. Further, in the illustrated embodiment the opening 30 is an open cutout, but could alternatively be a slotted or screened opening.

The base 20 defines a speaker support channel 32 surrounding the opening 30. The speaker support channel 32 is partly defined on the base wall 22 of the base 20 and partly defined on the semi-circular rim 26 of the base. The speaker support channel 32 is adapted to support a speaker. The speaker support channel 32 takes the shape of the opening 30 and thus in the illustrated embodiment is circular. The speaker support channel 32 could alternatively be a raised rim or a configuration of pins or bosses adapted to support the speaker.

The base 20 also includes a battery chamber 34. In the illustrated embodiment, the battery chamber 34 is cylindrical, but could have a different shape to allow for a differently shaped battery. The mouth of the chamber 36 is threaded to accept a battery cap 38 to seal the chamber. The chamber 34 could also be sealed in other manners, such as with a sliding or hinged mechanism.

A plurality of support bosses 40 project from the base wall 22 of the base 20, in a direction inwards towards the mask 12. Each one of the support bosses 40 is tapped to accept the thread of a screw. The illustrated embodiment includes four support bosses 40 in a square configuration, however, different numbers and configurations of support bosses could be used.

A plurality of mounting bosses 42 project from the base wall 22, in a direction outward from the mask 12. The illustrated embodiment includes three mounting bosses 42 arranged in a triangular configuration. However, different numbers and configurations of mounting bosses 42 could be used.

A number of attachment receptors 44 are located on the peripheral walls, 24 and 28, of the base 20 and of the semi-circular rim 26. Five attachment receptors 44 are depicted in the illustrated embodiment, but different numbers of attachment receptors could be used. In addition, other types of fasteners could be used, such as screws, glue, inter-engaging tabs and slots, or other fasteners.

The voice amplifier 10 includes a speaker 46. In the illustrated embodiment the speaker 46 is a common cone speaker, although other types of speakers could be used. The speaker 46 has a generally frustoconical shape centered on an axis 48. Because of its frustoconical configuration, the speaker has a wide end 50 and a narrow end 52.

The speaker 46 includes at its narrow end 52 a magnet assembly 54. The speaker 46 also includes a bowl-shaped frame 56 made of a suitable metal or plastic material. The speaker frame 56 includes a rim 58. The speaker frame 56 supports the magnet assembly 54.

The speaker 46 has a diaphragm 60 made of a suitable paper or plastic material. The speaker diaphragm 60 has a frustoconical configuration and is circular when viewed from its front or back, that is, from the right or left as viewed in FIG. 3. The speaker diaphragm 60 spans the gap between the magnet assembly 54 and the speaker frame rim 58.

The speaker 46 is supported on the speaker support channel 32 of the base 20. The wide end 50 of the speaker 46 faces toward the base opening 30, so that sound from the speaker can travel through the opening. The wide end 50 of the speaker is closer to the base opening 30 than the narrow end 52 of the speaker.

The voice amplifier 10 also includes a circuit board 62. The circuit board 62 is a printed circuit board and includes electrical circuitry for the amplification of the electrical signals from the microphone. The circuit board 62 is mounted on the base 20. One or more fasteners shown schematically at 64 secure the circuit board 62 to one or more mounting bosses 42 on the base 20. The circuit board 62 is electronically connected with the speaker 46 by wires (not shown).

The circuit board 62 is located below the speaker 46. Specifically, as can be seen in FIG. 2, the circuit board 62 is located in the lower portion of the base 20. The circuit board 62 is co-planar with at least a portion of the speaker 46, closer to or at the narrow end 52 of the speaker. The circuit board 62 is not located behind the magnet assembly 54 of the speaker, on the axis 48 of the speaker. The top-to-bottom extent of the base 20 allows the speaker 46 and the circuit board 62 to be located next to (above and below) each other rather than in line with (in front of and behind) each other.

A switch 66 is located on the circuit board 62. The switch 66 is an on/off switch for the voice amplifier 10. The switch 66 is preferably a magnetically actuated switch that changes state when a magnetic element or member is passed near the switch but other types of switches could also be used, including non magnetically actuated switches. In the illustrated embodiment a reed switch is used, but other types of magnetically actuatable switches could be used, for example, a Hall effect transistor.

The voice amplifier 10 includes a battery assembly 68 for powering the circuit board 62 and the speaker 46. The illustrated embodiment includes a commonly used cylindrical lithium battery 70 but other battery types and shapes could be used. The battery assembly 68 also includes two battery contacts (not shown) and the battery cap 38. The battery cap 38 is preferably molded out of the same plastic material as the base 20. The battery cap 38 screws into the base 20 to secure the battery 70 in the base.

The voice amplifier 10 also includes a cover 72. The cover 72 is preferably molded as one piece from a suitable plastic material. The configuration of the cover 72 is adapted to support and enclose other components of the voice amplifier 10. A plurality of attachment tabs 74 on the cover 72 fit within the attachment receptors 44 of the base 20, for securing the cover to the base. Five attachment tabs 74 are depicted in the illustrated embodiment, but different numbers of attachment tabs could be used. In addition, other methods could be used to attach the cover 72 to the base 20, for example, screws, glue, other adhesive, or other fasteners.

The cover 72 has a generally flat lower portion 76 with a peripheral wall 78 adapted to enclose other components of the assembly. The lower portion 76 of the cover has a front surface 80 which faces outward of the mask 12.

The front surface 80 of the cover 72 is recessed, inside a rim 82, to form a circular switch guide 84 on the cover. A switch actuator support boss 86 projects outward from the front surface of the lower portion 76 of the cover 72 in the center of the switch guide 84. The boss 86 defines a pivot axis 88 of the cover 72.

In the illustrated embodiment, the switch guide 84 has a ninety degree ramp sector 90 that is centered on the boss 86. However, ramp sectors of varying degrees could be used. The ramp sector 90 has a ramp surface 92. The ramp surface 92 has an over center configuration. Thus the ramp surface 92 projects farther out in the center of the ninety degree range forming a raised central portion 94, and is more deeply recessed toward and at the two ends of the ninety degree range.

The cover 72 has a semi-circular upper portion 96 that projects upward from the lower portion 76 of the cover. The upper portion 96 is located generally above the axis 48 of the speaker 46. The upper portion 96 of the cover 72 includes a base wall 98 and a peripheral wall 100 that extends from the base wall. The base wall 98 of the upper portion 96 of the cover 72 is not flat but instead curves inward (to the right as viewed in FIG. 3) from the lower portion 76 of the cover as it extends upward. The base wall 98 of the upper portion 96 of the cover 72 has an outer surface portion 99.

The cover 72 holds the speaker 46 in place on the base 20. Specifically, the cover 72 engages the magnet assembly 54 of the speaker and presses the speaker 46 against the base 20. As a result, the rim 58 of the speaker frame 56 is clamped in the speaker support channel 32, with the speaker diaphragm 60 facing toward the opening in the base 20, in an inward direction toward the mask 12. Alternatively, other methods of holding the speaker 46 in place could be used, for example, glue or another adhesive, clips or other attachment devices.

The curve of the base wall 98 of the upper portion 96 of the cover 72 is adapted to closely mimic the conical configuration of the speaker 46. As can be seen in FIG. 2, the magnet assembly 54 of the speaker 46 projects outward of the frame 56. The upper portion 96 of the cover 72 overlies the magnet assembly 54 of the speaker. The narrow end 52 of the speaker 46 is closer to the cover 72 than the wide end 50. The diaphragm 60 of the speaker 46 extends inward, toward the mask 12, as it extends outward from the magnet assembly 54.

The configuration of the cover 72 follows the narrow to wide configuration of the speaker 46; that is, the outer surface portion 99 of the upper portion 96 of the cover generally parallels the diaphragm 60 of the speaker. The circuit board 62 is not located between the speaker 46 and the outer surface portion 99 of the upper portion 96 of the cover 72. As a result, the cover 72 has a slimmer profile than it would if the upper portion 96 of the cover extended straight up from the lower portion 76, which would be necessary if the orientation of the speaker were reversed. The cover 72 also has a slimmer profile because the circuit board 62 is located not on line with but instead below the speaker 46, that is, not between the speaker 46 and the outer surface portion 99 of the upper portion 96 of the cover 72. This slimmer profile provides increased vision capability and maneuverability for the user of the mask 12.

The voice amplifier 10 includes a switch actuator assembly 102 to actuate the switch 66 on the circuit board 62. The switch actuator assembly 102 in the illustrated embodiment includes a magnetic actuator because the switch is a magnetically actuatable switch. If a type of switch other than a magnetically actuatable switch is used, then a different type of switch actuator could be used.

The switch actuator assembly 102 includes a lever 104. The lever 104 may be molded from the same plastic material as the cover 72. The lever 104 has an annular hub 106 from which a lever arm 108 extends. A screw 110 or other fastener secures the switch actuator lever 104 to the support boss 86. One or more seals (not shown) could be provided in the switch actuator assembly 102.

The hub 106 supports the lever 104 on the switch actuator support boss 86 of the cover 72 for pivotal movement on the support boss relative to the cover. The lever is movable through a range of motion between on and off positions at the ends of the ninety degree switch guide 84. Because the switch guide 84 has a ninety degree ramp sector 94, the lever 104 is pivotable through a ninety degree range of motion. If the switch guide 84 has a different degree range, the lever 104 would be pivotable through a different range of motion.

The switch actuator assembly 102 includes a magnet 116 attached to the lever arm 108 of the switch actuator lever 104. Thus, as the lever 104 moves through its range of pivotal movement, the magnet 116 also moves through that range of movement. The position of the magnet 116 on the lever 104 is selected so that the magnet moves toward and away from the switch 66 on the circuit board 62, as the lever is moved through its range of motion. Specifically, as the lever 104 is moved to the on position, the magnet 116 is brought close to the switch 66, and the switch is actuated to enable the voice amplification circuitry. When the lever 104 is moved to the off position, the magnet 116 is moved away from the switch 66, and the switch is de-actuated to disable the voice amplification circuitry.

The lever 104 has a guide dimple 118 that rides on the switch guide ramp surfaces 92 of the cover 72. As the lever 104 is pivoted between the on and off positions, the guide dimple 118 rides up one of the ramp surfaces 92 of the recessed switch guide 84 towards the raised central portion 94. Once the switch actuator lever 104 travels past the raised central portion 94, the guide dimple 118 of the switch actuator lever follows the other ramp portion 92 downward and snaps into either the on or off position as desired. Thus, the ramp surfaces 92 of the switch guide 84 provide an overcenter finction for the switch actuator lever 104, which is easily guided to be in either the on position or the off position, even when actuated by a user wearing heavy gloves. Further, the ninety-degree range of movement of the lever 104 provides a tactile indication of the on-off condition of the voice amplifier 10, as it is easy for a user to sense where the lever is and determine from that whether the switch 66 is on or off. The switch actuator assembly 102 may also include a detent member (not shown) in the form of a spring, for example, for helping to guide and control the movement of the lever.

When the cover 72 is assembled to the base 20, a sub-assembly of the voice amplifier 10 is formed. The sub-assembly includes the base 20, the cover 72, the speaker 46, the circuit board 62, and the switch actuator assembly 102. The voice amplifier 10 includes a sound reflector 120 that supports this sub-assembly on the mask 12, as described below.

The sound reflector 120 is preferably molded as one or more pieces from a suitable plastic, fiberglass, metal, metal alloy or polymer material. The sound reflector 120 has a bowl-shaped configuration including a flat, circular, main wall 122 and a curved side wall 124. The main wall 122 could be other than flat, for example, bell-shaped. The sound reflector 120 has a reflector surface 126 on the main wall and the side wall, that faces outward from the mask 12.

The sound reflector 120 has three support tabs 128 on its outer periphery that project inward for supporting the sound reflector on the mask 12. One of the support tabs 128 is adapted to include a locking assembly 130 for locking the sound reflector 120 on the mask 12. In the illustrated embodiment, the locking assembly 130 is a spring loaded locking lever but other methods of locking could be utilized. In addition, other methods of attaching the sound reflector 120 to the mask 12 could also be utilized.

A plurality of fastener openings 132 are formed in the main wall 122 of the sound reflector 120. The fastener openings 132 receive fasteners 134, such as screws, for securing the sound reflector 120 to the sub-assembly of the base 20 and its associated parts. Specifically, the fasteners 134 extend into the support bosses 40 to support the sound reflector 120 on the base 20. The support bosses 40 can be configured to mount a variety of sound reflectors to different masks. As a result, when the sound reflector is mounted on the mask 12, the sub-assembly of the base 20, cover 72, circuit board 62, speaker 46, and switch actuator assembly 102 is also supported on the mask.

When the sound reflector 120 and the sub-assembly are thus secured together, the circular central opening 30 in the base 20 is aligned with the main wall 122 of the sound reflector. The speaker 46 is also aligned with the main wall 122 of the sound reflector.

When the base 20 is secured to the sound reflector 120, the rim 26 on the upper portion of the base does not engage the sound reflector. A gap 136 is present between the base 20 and the sound reflector side wall 124. The gap 136 extends around the upper portion of the base 20. In the illustrated embodiment, the gap extends for about 270 degrees about the axis of the speaker 48.

When the switch 66 is on and the user speaks, the circuitry of the circuit board 62 amplifies the signal from the microphone (not shown) and causes the speaker 46 to generate sound waves accordingly, the speaker and the circuit board being connected by wiring. Sound from the speaker 46 is directed through the opening in the base 30 to the reflector surface 126 on the sound reflector 120. The bowl-shaped configuration of the sound reflector 120 causes sound waves from the speaker to change direction in a curved path and be reflected outward, as shown by the arrows in FIG. 1. The sound waves travel outward through the gap 136 between the base 20 and the sound reflector 120, changing direction as they do so. Thus, the sound from the speaker 46 first travels inward toward the mask 12, then is reflected and travels outward away from the mask, as is desired so that others nearby can hear the sound. Because of the presence of the sound reflector 120, the speaker 46 can be oriented inward toward the mask 12. Because the speaker 46 is oriented inward, the cover 72 can be made slimmer, as described above.

The invention claimed is:

1. A voice amplifier for attachment to a mask, said voice amplifier comprising: a speaker having a front face that faces inwardly of said mask when said voice amplifier is attached to said mask; a sound reflector having a reflector surface that faces outwardly of said mask when said voice amplifier is attached to said mask; a base connected with said sound reflector, said speaker supported on said base such that said front face of said speaker faces towards said reflector surface of said sound reflector, said front face of said speaker designed to generate sound waves that travel toward said reflector surface, said reflector surface designed to reflect said sound waves generated from said speaker back toward said speaker and outwardly from said mask when said amplifier is attached to said mask.

2. The voice amplifier according to claim 1, wherein said sound reflector supports said base and said speaker on said mask, at least a portion of said base positioned between said speaker and said sound reflector.

3. The voice amplifier according to claim 1, wherein said front face of said speaker has a conical configuration centered on an axis and tapering radially inward in a direction away from said mask.

4. The voice amplifier according to claim 1, wherein at least a portion of said sound reflector and said base are spaced apart thereby defining a peripheral gap between them, said sound waves emitted from said speaker being reflected off said sound reflector and exiting said voice amplifier through said peripheral gap.

5. A voice amplifier for attachment to a mask, said voice amplifier comprising a sound reflector having a reflector surface that faces outwardly of the mask when the voice amplifier is attached to the mask, a base connected with the sound reflector, and a speaker supported on said base and facing inwards towards said reflector surface, said sound reflector having a circular shape with a perimeter and an outer diameter, said base comprising a lower base portion and an upper base portion, said upper base portion having a generally semi-circular shape with an outer diameter that is smaller than said outer diameter of said perimeter of said sound reflector thereby defining a gap between said upper base portion and said perimeter of said sound reflector, said sound reflector and said base are spaced apart thereby defining a peripheral gap between them, sound waves emitted from said speaker being reflected off said sound reflector and exiting said voice amplifier through said peripheral gap.

6. The voice amplifier according to claim 1, wherein said sound waves that emanate from said speaker inward towards said sound reflector, reflect off said sound reflector and exit said voice amplifier through an outer peripheral gap between said base and said perimeter of said sound reflector and thence travel outwardly from said mask.

7. The voice amplifier according to claim 1, comprising switch and a movable switch actuator mounted on said front of said voice amplifier.

8. The voice amplifier according to claim 1, comprising a magnetically actuated switch and a movable magnetic switch actuator mounted on the said front of the voice amplifier.

9. The voice amplifier according to claim 1, wherein a cover has an outer surface portion facing away from said mask, said voice amplifier further comprising a circuit board located within said housing at a location not between said speaker and said outer surface portion of said cover.

10. A voice amplifier for attachment to a mask, said voice amplifier comprising a sound reflector having a reflector surface that faces outwardly of the mask when the voice amplifier is attached to the mask, a base connected with the sound reflector, a speaker supported on said base and facing inwards towards said reflector surface, and a cover connected with said base, said cover having a front wall with a front surface facing away from said mask when said voice amplifier is attached to said mask, said speaker having a wide end and a narrow end, said narrow end of said speaker being located closer to said front wall of said cover than said wide end, said cover front wall having a profile that follows said profile of speaker in a direction from said narrow end of said speaker to said wide end of said speaker.

11. A voice amplifier for attachment to a mask, said voice amplifier comprising: a base; a speaker supported on said base; and a cover connected with said base to form a housing enclosing said speaker, said cover having a front wall with a front surface facing away from said mask when said voice amplifier is attached to said mask, said speaker having a wide end and a narrow end, said narrow end of said speaker located closer to said front wall of said cover than the wide end, said cover front wall having a profile that follows a profile of said speaker in a direction from said narrow end of said speaker to said wide end of said speaker, said wide end of said speaker having a front face that faces inwardly of said mask when said voice amplifier is attached to said mask.

12. The voice amplifier according to claim 11, wherein said speaker has a conical or frustoconical configuration centered on an axis and said cover front wall has a profile that mimics said speaker configuration above said axis of said speaker.

13. The voice amplifier according to claim 11, further comprising an on/off switch assembly including a magnetic actuator that is located on an outer front surface of said cover facing away from the mask, and a magnetically actuated switch located inward of said cover.

14. A voice amplifier for attachment to a mask, said voice amplifier comprising a sound reflector; a base connected with said sound reflector; a cover having an outer surface portion facing away from said mask; a circuit board; and a speaker positioned between said cover and said sound reflector, said cover being attached to said base to form with said base a housing for said speaker said circuit board located within said housing at a location that is not behind a magnet assembly of said speaker, said speaker having a front face that faces inwardly of said mask when said voice amplifier is attached to said mask.

15. The voice amplifier according to claim 14, wherein said speaker faces toward said sound reflector and has a portion closest to said sound reflector, and said circuit board is located within the housing at a location outward of said speaker portion closest to said sound reflector.

16. The voice amplifier according to claim 15, further comprising an on/off switch assembly including a magnetic actuator that is located on said outer surface of said cover facing away from said mask.

17. The voice amplifier according to claim 16, wherein said on/off switch assembly also includes a magnetically actuated switch located on said circuit board inward of said cover.

18. A voice amplifier for attachment to a mask, said voice amplifier comprising: a housing including a base and a cover; an on/off switch assembly including a magnetically actuatable switch and a magnetic actuator; an amplifier inside said housing for amplifying a signal received from a microphone, said amplifier being controlled by said magnetically actuatable switch; and a speaker connected with said amplifier inside said housing, said speaker converting said signal received from said amplifier into sound waves, said speaker having a front face that faces inwardly of said mask when said voice amplifier is attached to said mask.

19. The voice amplifier according to claim 18, wherein said magnetic actuator is supported on a movable member on said cover for movement between a first position and a second position, and said magnetically actuated switch is located on a circuit board inside said housing, said magnetically actuated switch moving between an on condition and an off condition in response to movement of said magnetic actuator between said first position and said second position.

20. The voice amplifier according to claim 19, wherein said magnetically actuated switch is a reed switch.

21. The voice amplifier according to claim 18, wherein said magnetic actuator is pivotable within a range of movement between an on position and an off position and is mounted on said front of the voice amplifier.

22. The voice amplifier according to claim 18, wherein said magnetic actuator is mounted on the said front of the voice amplifier.

23. The voice amplifier according to claim 18, wherein said magnetic actuator is mounted on said front of the voice amplifier and is pivotable within a range of movement between an on position and an off position, and magnetically actuated switch is located on a circuit board inside said housing, said magnetically actuated switch moving between an on condition and an off condition in response to movement of said magnetic actuator between said first position and said second position.

24. The voice amplifier according to claim 18, including a sound reflector having a reflector surface that faces outwardly of said mask when the voice amplifier is attached to said mask, said base being connected with said sound reflector; and said speaker being supported on said base and facing inwards towards said reflector surface.

25. The voice amplifier as set forth in claim 18, comprising a sound reflector, said base being connected with said sound reflector, a cover having an outer surface portion facing away from said mask, said voice amplifier further comprising a circuit board located within said housing at a location not between said speaker and said outer surface portion of said cover.

26. A voice amplifier for attachment to a mask, said voice amplifier comprising a housing including a base and a cover, an on/off switch assembly including a magnetically actuatable switch and a magnetic actuator, an amplifier inside said housing, for amplifying a signal received from a microphone, and a speaker connected with said amplifier inside said housing, said amplifier being controlled by said magnetically actuatable switch, said speaker converting said signal received from said amplifier into sound waves, said cover having a front wall with a front surface facing away from said mask when said voice amplifier is attached to said mask, said speaker having a wide end and a narrow end, said narrow end of said speaker being located closer to said front wall of said cover than said wide end, said cover front wall having a profile that follows said profile of said speaker in a direction from said narrow end of said speaker to said wide end of said speaker.

27. A voice amplifier for attachment to a mask, said voice amplifier comprising a speaker having a front face that faces inwardly of said mask when said voice amplifier is attached to said mask; a sound reflector having a reflector surface that faces outwardly of said mask when said voice amplifier is attached to said mask, said front face of said speaker facing towards said reflector surface of said sound reflector, said front face of said speaker designed to generate sound waves that travel toward said reflector surface, said reflector surface designed to reflect said sound waves generated from said speaker back toward said speaker and outwardly from said mask when said amplifier is attached to said mask.

28. The voice amplifier according to claim 27, including a circuit board, said circuit board not positioned behind a magnet assembly of said speaker.

29. The voice amplifier according to claim 28, wherein said circuit board is not positioned forwardly of said front face of said speaker.

30. The voice amplifier according to claim 27, including a cover, said cover having an outer surface portion facing away from said mask when said voice amplifier is connected to said mask, said speaker positioned between said cover and said sound reflector.

31. The voice amplifier according to claim 28, including a cover, said cover having an outer surface portion facing away from said mask when said voice amplifier is connected to said mask, said speaker positioned between said cover and said sound reflector.

32. The voice amplifier according to claim 30, including a base at least partially positioned between said cover and said sound reflector, at least one peripheral gap exists between said sound reflector and said base such that sound waves emitted from said speaker are at least partially reflected off said sound reflector and exit through said peripheral gap.

33. The voice amplifier according to claim 31, including a base at least partially positioned between said cover and said sound reflector, at least one peripheral gap exists between said sound reflector and said base such that sound waves emitted from said speaker are at least partially reflected off said sound reflector and exit through said peripheral gap.

34. The voice amplifier according to claim 32, wherein said speaker is at least partially supported on said base when said voice amplifier is attached to said mask.

35. The voice amplifier according to claim 33, wherein said speaker is at least partially supported on said base when said voice amplifier is attached to said mask.

36. The voice amplifier according to claim 35, wherein said cover at least partially clamps said speaker to said base when said voice amplifier is attached to said mask.

37. The voice amplifier according to claim 32, wherein said base includes a power housing designed to hold a power supply, said power supply designed to power at least one component of said voice amplifier.

38. The voice amplifier according to claim 37, wherein said power housing includes a removable cover to enable replacement of a power supply contained in said power housing.

39. The voice amplifier according to claim 27, including a switch and a movable switch actuator mounted on said front of said voice amplifier.

40. The voice amplifier according to claim 36, including a switch and a movable switch actuator mounted on said front of said voice amplifier.

41. The voice amplifier according to claim 39, wherein said switch is a magnetically actuated switch and said switch actuator is a movable magnetic switch actuator.

42. The voice amplifier according to claim 30, including a switch and a movable switch actuator mounted on said front of said voice amplifier, said switch located in a recessed cavity on said outer surface portion of said cover.

43. The voice amplifier according to claim 40, including a switch and a movable switch actuator mounted on said front of said voice amplifier, said switch located in a recessed cavity on said outer surface portion of said cover.

44. The voice amplifier according to claim 30, wherein said speaker has a wide end and a narrow end, said narrow end of the speaker is located closer to said cover than said wide end of said speaker, said cover having an inner surface portion that has a profile that follows a profile of said speaker in a direction from said narrow end of said speaker to said wide end of said speaker.

45. The voice amplifier according to claim 43, wherein said speaker has a wide end and a narrow end, said narrow end of the speaker is located closer to said cover than said wide end of said speaker, said cover having an inner surface portion that has a profile that follows a profile of said speaker in a direction from said narrow end of said speaker to said wide end of said speaker.

46. The voice amplifier according to claim 32, wherein said base includes an opening positioned at least partially in front of said front face of said speaker when said voice amplifier is attached to said mask, said opening in said base designed to allow said sound waves emitted from said speaker to pass through said opening, contact said sound reflector and then be at least partially reflected off said sound reflector.

47. The voice amplifier according to claim 45, wherein said base includes an opening positioned at least partially in front of said front face of said speaker when said voice amplifier is attached to said mask, said opening in said base designed to allow said sound waves emitted from said speaker to pass through said opening, contact said sound reflector and then be at least partially reflected off said sound reflector.

* * * * *